US005639088A

United States Patent [19]

Schneider et al.

[11] Patent Number: 5,639,088

[45] Date of Patent: Jun. 17, 1997

[54] MULTIPLE EVENTS AWARD SYSTEM

[75] Inventors: Richard J. Schneider; Miles Martin Patceg, both of Las Vegas; Robert James Craig, Henderson, all of Nev.

[73] Assignee: United Games, Inc., Las Vegas, Nev.

[21] Appl. No.: 515,833

[22] Filed: Aug. 16, 1995

[51] Int. Cl.[6] ..... A63F 9/22

[52] U.S. Cl. ..... 273/138.2; 463/25; 463/13; 463/42; 463/43

[58] Field of Search ..... 273/143 R, 138.2; 463/12, 13, 20, 25–27, 42, 43

[56] References Cited

U.S. PATENT DOCUMENTS

| | | | |
|---|---|---|---|
| 4,570,934 | 2/1986 | Smyth | 273/143 R |
| 4,624,459 | 11/1986 | Kaufmann | 273/143 R |
| 4,861,041 | 8/1989 | Jones et al. | 273/292 |
| 4,948,134 | 8/1990 | Suttle et al. | 273/85 CP |
| 5,022,653 | 6/1991 | Suttle et al. | 273/85 CP |
| 5,048,833 | 9/1991 | Lamle | 273/138.2 |
| 5,078,405 | 1/1992 | Jones et al. | 273/309 |
| 5,154,420 | 10/1992 | Gutnecht | 273/138.2 |
| 5,265,874 | 11/1993 | Dickinson et al. | 273/138.2 |
| 5,275,400 | 1/1994 | Weingardt et al. . | |
| 5,374,067 | 12/1994 | Jones | 273/292 |
| 5,377,973 | 1/1995 | Jones et al. | 273/292 |
| 5,393,057 | 2/1995 | Marnell | 273/269 |
| 5,401,023 | 3/1995 | Wood . | |
| 5,429,361 | 7/1995 | Raven et al. | 463/25 |

*Primary Examiner*—Benjamin H. Layno

*Attorney, Agent, or Firm*—Knobbe, Martens, Olson & Bear, LLP

[57] ABSTRACT

A system whereby a plurality of players can play a plurality of different gaming machines. The performance of the plurality of players is recorded through multiple rounds of the game and awards are provided based upon the performance of a player over multiple rounds of the game. In the preferred embodiment, the plurality of gaming machines are video poker machines and the players play these machines in order to obtain the well-known winning combinations. The gaming machines provide signals to a central computer that records in files for each of the players the winning combinations received by the players and the number of rounds played by the players. The central computer also determines whether the player has received a set of winning combinations, e.g., all thirteen possible different four-of-a-kinds, within a pre-selected number of rounds. When the player has received the set of winning combinations, the player receives a large award the value of which is selected so that the overall hold percentage of the gaming system is maintained while taking into consideration large awards dispensed to the players.

33 Claims, 4 Drawing Sheets

MULTIPLE EVENTS AWARD SYSTEM

BACKGROUND OF THE INVENTION

1. Field of the Invention

The present invention relates to gaming systems and, in particular, to gaming systems which provide awards to players as a result of the individual player's performance over multiple iterations of the game.

2. Description of the Related Art

Currently, gambling has become a very popular form of entertainment throughout the world. One of the most popular forms of gambling or gaming is through gaming machines such as slot machines, video poker machines and other video card machines. These machines are generally configured to dispense awards based on the player obtaining certain winning combinations and to retain a certain percentage of all monies wagered by the players for the owner of the machine. The percent of monies retained by the machine is generally referred to as the hold percentage.

One shortcoming of the typical gaming machine is that the maximum award that can be given by the machine, while still retaining the desired hold percentage for the machine, is limited. The awards given by the machine for certain winning combinations are typically calculated, based on the probability of occurrence of the winning combinations, so that the machine retains the desired hold percentage of monies wagered. Hence, the maximum award that the machine can give for a winning combination is limited by the probability of occurrence of the least likely winning combination.

For example, in the standard video poker game, the maximum award is generally given for the winning combination of a royal flush. The probability of occurrence of a royal flush for a single 52 card deck is approximately 1 in 40,000. Generally, most video poker gaming machines give an award of about 800–1,000 coins per coin wagered for a royal flush. Awards in this range, in conjunction with those awards paid for lesser hands, ensure that a desirable hold percentage of the game is maintained.

It can be appreciated, however, that it is often desirable to increase the maximum award given by a gaming machine without altering the hold percentage. One way of increasing the popularity of a particular gaming machine in a casino environment is to offer extremely large awards for that particular game. However, it is also generally desirable to retain the basic, well-known characteristics of the gaming machine so that players do not have to learn how to play a new game.

One example of where existing games have been slightly altered to allow for larger awards is the linked progressive slot machines. In many gaming establishments, gaming machines, such as slot machines, are electronically linked together and a percentage of all monies wagered on each machine is accrued into a progressive account. The progressive account is then distributed to the first person on one of the linked gaming machines who attains a particular winning combination.

One difficulty with the standard progressive-type gaming machine is that the player is competing against other players for a particular jackpot. If the player stops playing, the player can no longer play for that particular jackpot. Further, once a particular jackpot is won, the progressive machines generally reset the progressive jackpot amount at a lower number. Hence, the progressive jackpot games limit the flexibility of the player to play the game for a particular jackpot at a time of their choosing. Still further, the progressive machines generally dispense the jackpot for only a single particular winning combination and not any of a number of winning combinations.

Another type of gaming system that is used to increase the popularity of a particular game is a player's club system. In this system, each player receives a card which they insert into a gaming machine that is linked to a central computer. The central computer then keeps track of some variables, e.g., the total coins wagered by the player, the time spent by the player playing the game, etc., and offers promotional awards to the player based upon these variables. While this encourages the players to play particular games, the awards given are generally limited in value.

Hence, there is a need for a gaming system that can offer large awards to the players for playing a particular game without limiting the flexibility of the player to select the optimum time to play the game and without changing the basic nature of the game. Further, the gaming system should also be capable of dispensing very large awards so that the hold percentage of the gaming machine is not affected. To this end, it would be desirable to base the award on the probability of obtaining a certain set of winning combinations to thereby support a very large award without significantly affecting the overall hold percentage of the gaming machine.

SUMMARY OF THE INVENTION

The aforementioned needs are satisfied by the present invention which is comprised of a gaming system that includes a central controller and at least one gaming machine. The gaming machine is configured to provide the controller with an indication of the player who is playing the gaming machine and an indication of the success of the player playing the gaming machine. The controller maintains a record for the player indicative of the number of rounds or iterations of the game. The controller also maintains a record of the number of times the player has received one or more of a particular set of winning combinations. The system can then be configured to offer the player enhanced awards for obtaining a given number or a given set of winning combinations within a given number of rounds.

For example, in the preferred embodiment, one or more video poker machines are linked together via a network to a central controller. The video poker machines include a player identification device, such as a card reader or keypad, which the player manipulates to signal to the central controller that he is currently playing the video poker machine. The video poker machine then periodically sends signals to the central controller indicative of the number of rounds played by the player and the winning combinations achieved by the player.

In the preferred embodiment, the player will receive an award from the gaming machine for obtaining a winning combination. The system can then determine whether the player has achieved a certain number or a certain set of winning combinations within a certain number of rounds and award the player a second award when the player has received the number set of winning combinations. Preferably, the probability of the player obtaining each of the winning combinations in a particular round can be calculated. Hence the overall probability of the player obtaining the required set or number of winning combinations within a particular number of rounds can also be calculated. The system can thus be configured to give large second awards for obtaining a certain set of winning combinations within a certain number of rounds wherein the exact value of the second award is calculated using the probability of obtaining the set of winning combinations corresponding to the second award so that the overall hold percentage of the gaming machine remains at a desired level.

It can be appreciated that the probability of achieving a given number or a given set of winning combinations within a given number of rounds can be very low. Hence, very large winning awards can be dispensed without significantly diminishing the overall hold percentage of the gaming machine. In the preferred embodiment, the gaming machine offers the players very large awards for obtaining a certain number or a certain set of winning combinations without significantly diminishing the overall hold percentage of the gaming machine and without altering the basic characteristics of the game.

Further, the system is preferably configured so that the player can play for a particular enhanced award at different time intervals. In the preferred embodiment, the player manipulates a player identification input device comprised of a keypad to identify himself to the central controller and the central controller maintains a tally corresponding to each of the rounds played and the winning combinations obtained while the player is playing the game. Since the central controller keeps a tally of the awards and rounds played by the player over time, the player is free to stop playing the game and then restart playing the game at a subsequent time while the controller maintains the tally of the player's individual performance. Since the player is not competing against other players to obtain a particular winning combination first, the player can select the times to play the game at his leisure without risking losing any possibility of winning a particular jackpot to another player.

In the preferred embodiment, the gaming system is also configured so that the player can reset the game at any time. To do this, the player simply depresses an appropriate button (or buttons) on the gaming machine which then sends a signal to the central controller which then resets the tally of winning combinations and rounds played in the memory of the central controller.

From the foregoing, it can be appreciated that the gaming system of the preferred embodiment allows the player to play for large awards in a very flexible fashion. Further, these very large awards can be based on the overall probability of the player obtaining a particular set of awards within a particular number of rounds and the desired hold percentage of the gaming system. These and other objects and features of the present invention will become more fully apparent from the following description and appended claims taken in conjunction with the accompanying drawings.

DETAILED DESCRIPTION OF THE PREFERRED EMBODIMENTS

Figure 1:
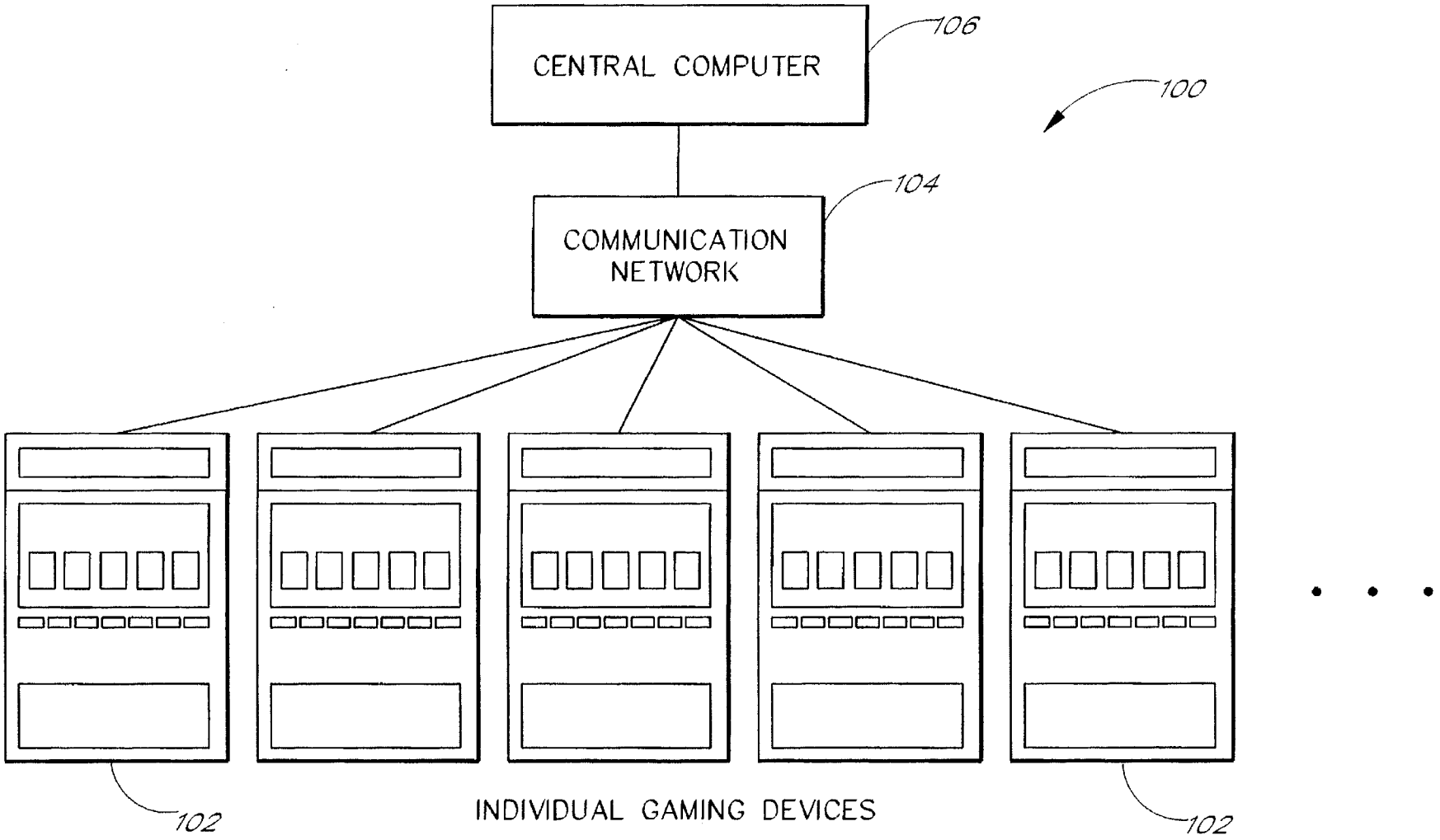
FIG. 1 is a block diagram which illustrates our preferred embodiment of the gaming system of the present invention.

Reference will now be made to the drawings wherein like numerals refer to like parts throughout. FIG. 1 illustrates the basic configuration of a gaming system 100 of the preferred embodiment. The gaming system 100 includes a plurality of gaming devices 102 which are electronically interconnected to a central computer 106 via a communication network 104.

Figure 2:
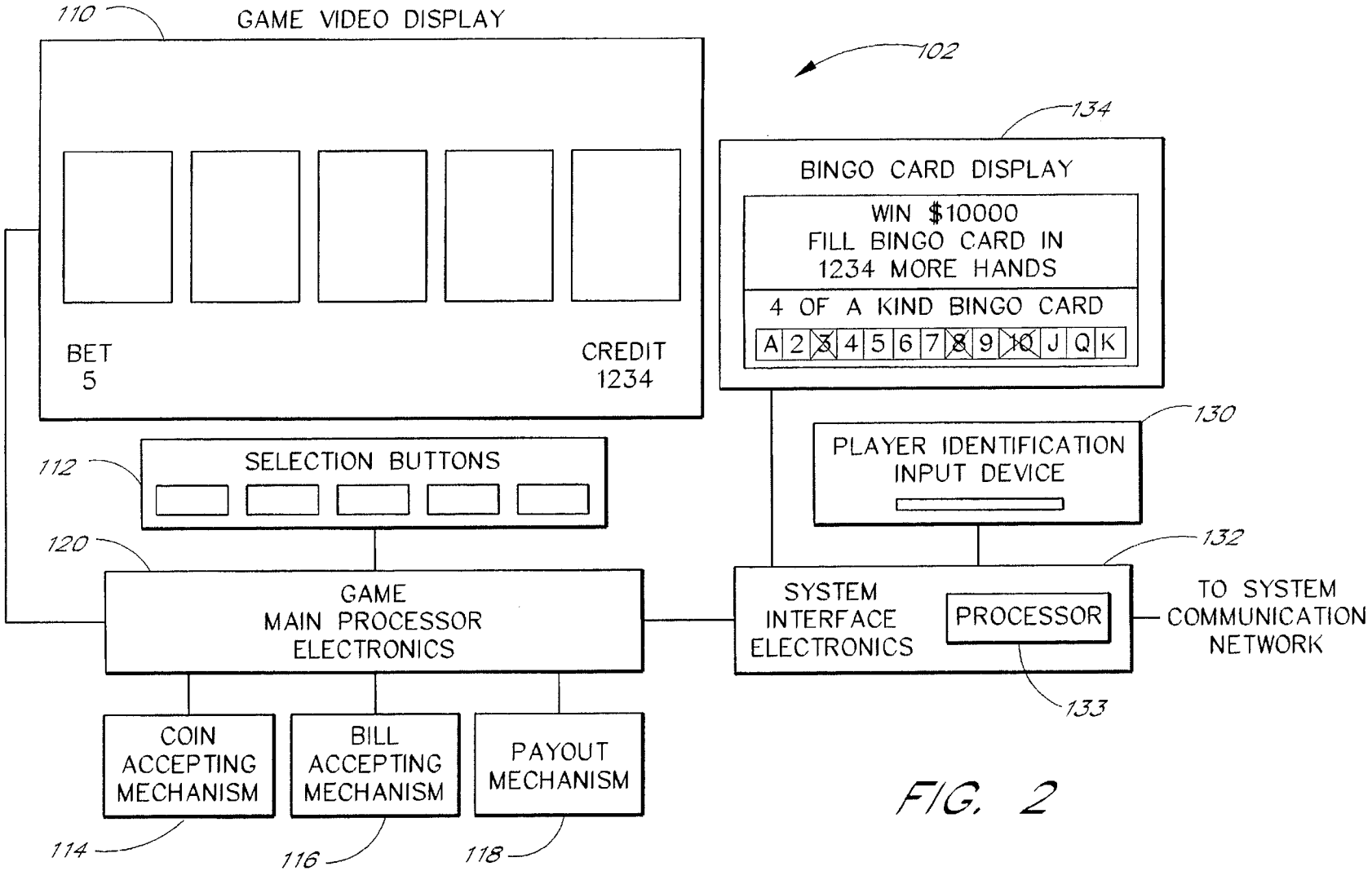
FIG. 2 is a block diagram which illustrates a gaming machine and a central controller of the system of FIG. 1.

Referring to FIG. 2, the gaming devices 102 in the preferred embodiment are comprised of video poker machines. The video poker machines can comprise video poker machines selected from those commercially available, such as a Model 906III Casino Mini Video Poker Machine manufactured by United Coin Machine Company of Las Vegas, Nev. The communications network 104 can be comprised of any of a number of well-known networks for interconnecting electronic devices, including those network configurations commonly used for data collection in casino environments. In the preferred embodiment, each of the games in a single location are linked together using an RS 485 local area network. The network 104 provides signals, preferably via a modem (not shown), to a central location. In the preferred embodiment, there is a personal computer (not shown) which receives the signals from up to thirty-two local area networks and processes these signals. The personal computers process the signals and then communicate with the central computer 106. The purpose of the personal computers is to simplify the communication between the central computer 106 and the local area networks so the personal computers essentially act as a communications buffer in a well-known fashion. The central computer is a transaction computation computer which is capable of performing multiple transactions simultaneously and, in the preferred embodiment, is a Model 130 Transaction Computer from Stratus Inc. of Marlboro, Mass.

As shown in FIG. 2, in the preferred embodiment, the video poker machine 102 includes a display 110, a plurality of user input buttons 112, a coin accepting mechanism 114, a bill accepting mechanism 116, a payout mechanism 118, and a game main processor 120. Additionally, however, the gaming devices 102 of the preferred embodiment, include a player identification input device 130, system interface electronics 132 and a winning set display 134. Further, the system interface electronics 132 includes a processor 133 which performs functions described in reference to FIG. 4 hereinbelow. In the preferred embodiment, the processor 133 is comprised of an Intel model 8051 microcontroller that is programmed to implement the functions described in reference to FIG. 4.

In response to a player both depositing a coin into the coin accepting mechanism 114, or inserting a bill into the bill accepting mechanism 116, and depressing one of the user input buttons 112 to initiate a new round or hand of the game, the game processor 120 electronically shuffles an electronic representation of a 52 card deck of cards and induces the display 110 to display five representations of playing cards. The player then manipulates the user input buttons 112 to select the cards on the display 110 that the player wishes to hold. The player then manipulates one of the user input buttons 112 to replace the non-selected cards and the processor 120 then replaces the non-selected cards with cards randomly selected from the 52 card deck.

The game processor 120 then determines whether the remaining five cards comprise one of a pre-selected number of winning combinations and, if so, pays an appropriate winning award by activating the payout mechanism 118. In the preferred embodiment, the game processor 120 is programmed to provide an award to the player via the payout mechanism 118 according to an awards table, such as Table No. 1, whenever the player achieves one of the winning combinations.

TABLE I

| FINAL HAND | AWARD AMOUNT (Coins Won Per Coin Wagered) |
|---|---|
| Pair of Jacks or Better | 1 |
| Two Pairs | 2 |
| Three-of-a-Kind | 3 |
| Straight | 4 |
| Flush | 5 |
| Full House | 8 |
| Four-of-a-Kind | 25 |
| Straight Flush | 50 |
| Royal Flush | 800 |

The foregoing description describes the operation of the typical prior art video poker machine. The system 100 of the preferred embodiment uses a plurality of these types of machines which offer awards each time the player receives a winning combination to develop a system wherein a second, preferably larger, award is given when the player has obtained a pre-selected set of winning combinations. Hence, with the system of the preferred embodiment, the player not only receives awards for obtaining winning combinations from the gaming machine 102, but the player also receives an award for receiving a pre-selected set of winning combinations. In one embodiment, the video poker machine 102 is modified to include the player identification input device 130, the system interface electronics 132 and the supplementary display 134 which is used to implement the preferred embodiment of the multiple events awards system of the present invention.

Specifically, the player identification input device 130 is comprised, in the preferred embodiment, of a keypad. Each player is assigned a unique member number, e.g., an account number, and a personal identification number that the player enters using the keypad comprising the player identification input device 130. A signal is then sent, via the system interface electronics 132, to the central computer 106 (FIG. 1) indicating that a particular player is playing the gaming machine 102. Further, the gaming machine 102 is also configured to provide signals to both the processor 133 and the central computer 106, via the system interface electronics 132, which are preferably indicative of whether the player has played a round, whether the player won and, if the player did win, which winning combination the player received. The processor 133 and the central computer 106 then update a record of the number of rounds played by the player and the winning combinations received by the player in the manner described hereinbelow in reference to FIGS. 3 and 4.

In the preferred embodiment, the system 100 implements a game whereby the player initially attempts to obtain winning combinations from the gaming machine and subsequently attempts to achieve either a certain number of winning combinations or a certain set of winning combinations within a pre-selected number of rounds played. It can be appreciated that, since the player will be playing multiple rounds of the game, the awards given for obtaining a particular set of combinations within a pre-selected total number of rounds can be very large without significantly altering the hold percentage of the gaming machine 102. In the embodiment shown in FIG. 2, the display 134 is displaying that if the player achieves four-of-a-kinds for Aces, Twos, Threes, Fours, Fives, Sixes, Sevens, Eights, Nines, Tens, Jacks, Queens and Kings within 1,234 rounds played, the player will receive an award of $1000.00 for wagers of 0.25 cents per round. Alternatively, awards could be paid according to a table, such as Table II, wherein the award amounts are calculated to retain a desirable hold percentage for the video poker machines in the gaming system 100.

TABLE II

| Hit all 13 four-of-a kinds in: | |
|---|---|
| 2,000 hands or less to win | $100,000 |
| 3,000 to 2001 hands to win | $1,000 |
| 4,000 to 3001 hands to win | $100 |
| 6,000 to 4001 hands to win | $20 |
| 7,000 to 6001 hands to win | $10 |
| 49,999 to 7001 hands to win | $5 |
| After 50,000 hands win (consolation prize) | $5 |

The awards listed in Table II assume that the player is wagering 5 coins in each round while playing on a 25 cent machine. Giving awards for all 13 four-of-a-kinds according to this awards table only decreases the hold percentage of the video poker game 102 by 0.14%. Hence, the system 100 of the preferred embodiment can be adapted to provide very large awards, given for extended play on the system, without significantly affecting the overall hold percentage of the individual video game poker games 102.

Preferably, the central computer 106 and the processor 133 update records in the memory so that the memory is indicative of the total number of rounds played by the player and the winning combinations received by the player. The central computer 106 and the processor 133 also preferably provides signals to the display 134 to update the display to indicate the winning combinations achieved by the player and the number of hands left/played.

Figure 3:
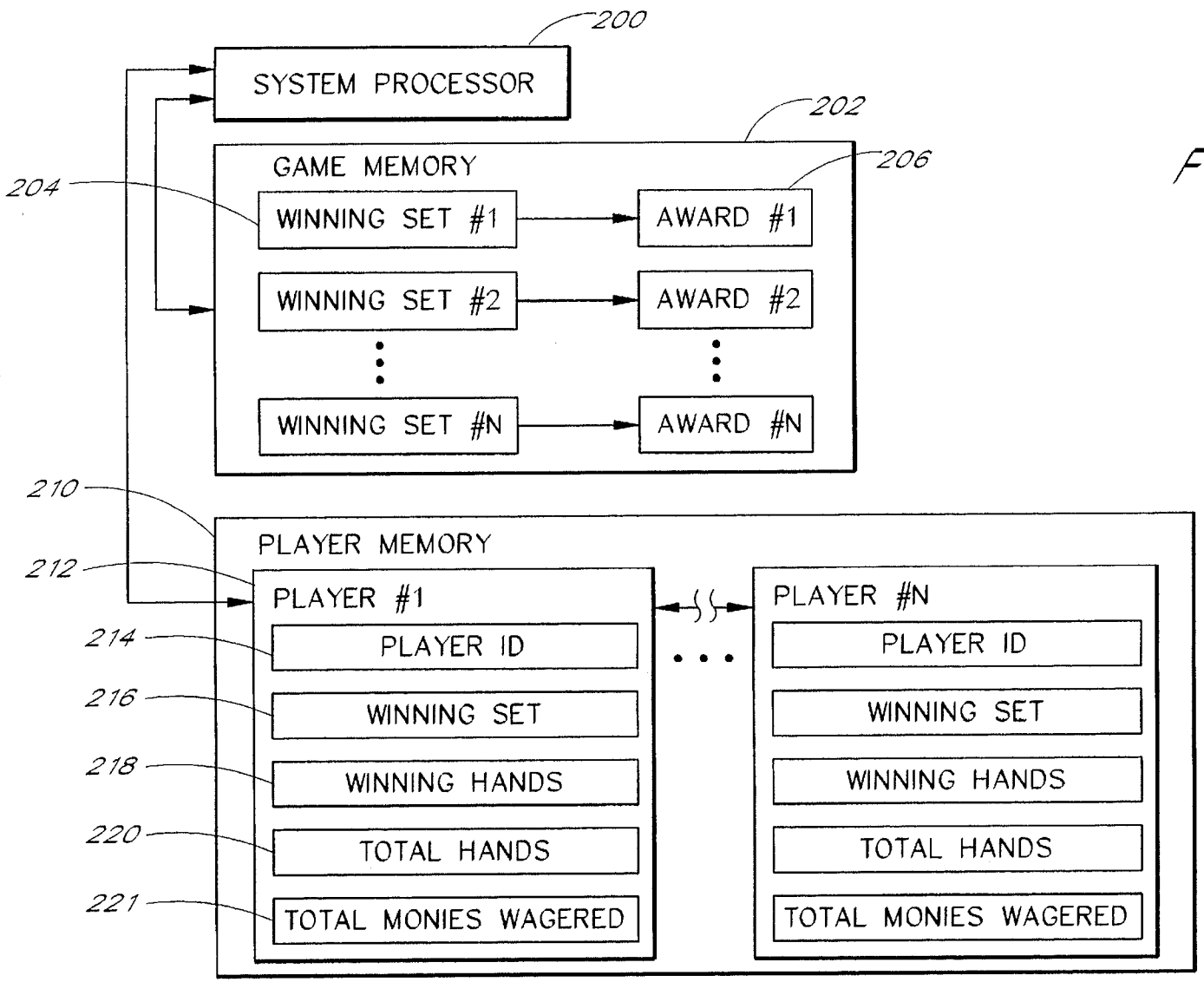
FIG. 3 is a functional block diagram illustrating one preferred embodiment of the organization of the memory of the central controller.

FIG. 3 illustrates one preferred organization of the central computer 106. The central computer 106 preferably includes a system processor 200 that is capable of simultaneously receiving multiple inputs from multiple machines 102 and updating information stored in a memory for multiple different players. Further, the central computer 106 is also logically organized to include a game memory 202 wherein the sets of winning combinations 204 and corresponding awards tables 206 comprising the multiple events games are stored. It can be appreciated that the central computer 106 can store a plurality of multiple events games comprised of games having different sets of winning combinations and different corresponding awards tables. The players can then select the game that they wish to play when they receive their identification means and the central computer 106 then issues awards and updates the display 134 (FIG. 2) in accordance with the multiple events game selected by the player.

The central computer 106 is also preferably organized to include a player memory 210 that has a player file 212 for each of the players 1 - N that have been assigned identification means. The player file 212 preferably includes a player ID line 214 which includes information about the player, e.g., his or her name, a winning set line 216 which includes information about the multiple events game selected by the player, a winning hand line 218 which contains information about the winning hands, i.e., the winning combinations received by the player, a total hands line 220 which contains information about the total number of hands received by the player, i.e., rounds played by the player, and a monies wagered line 221 having information about the total monies wagered by the player over the course of the game.

Figure 4:
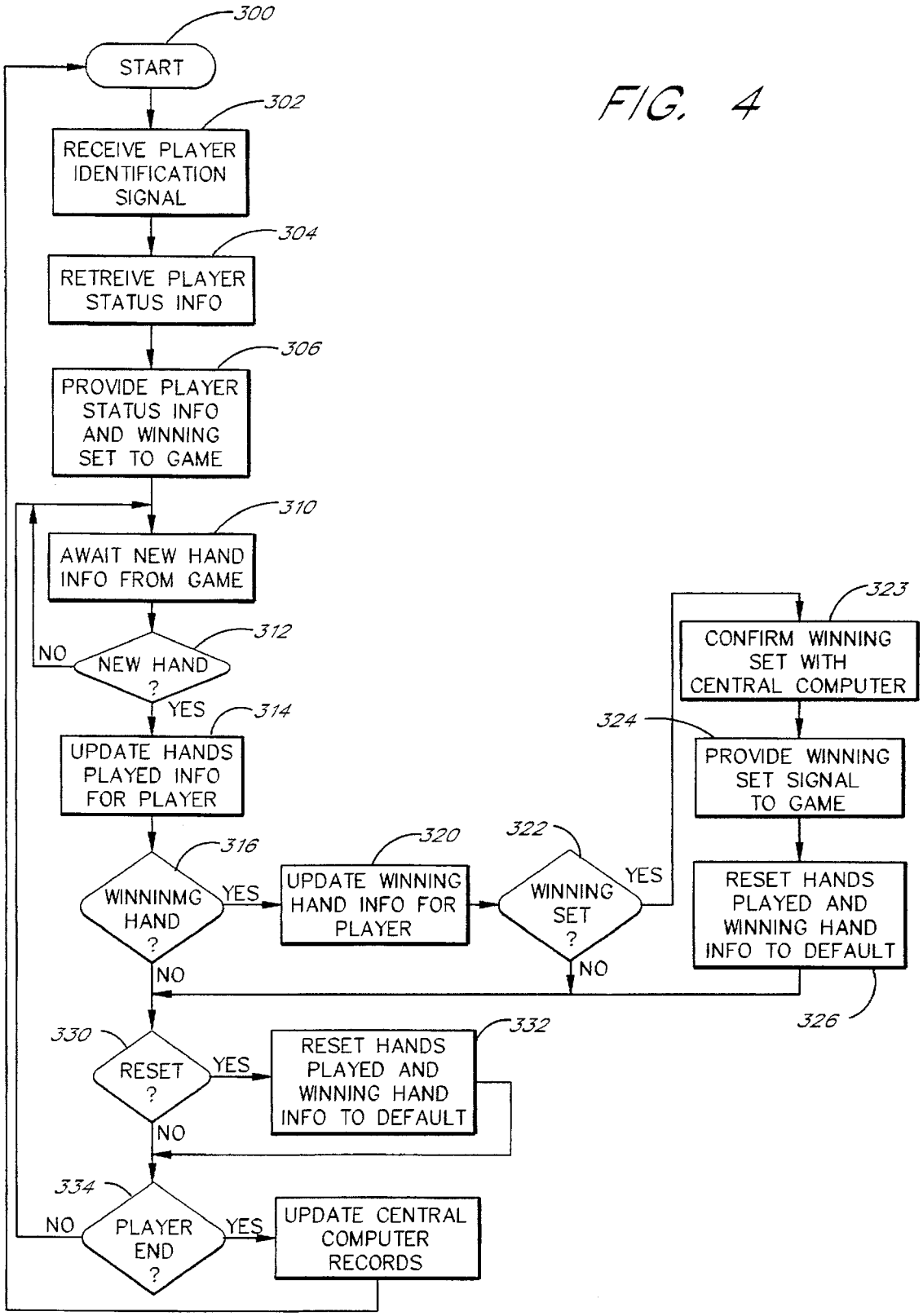
FIG. 4 is a flow chart illustrating the functional steps performed by the gaming system while a player is playing the gaming system of the present invention.

As is explained in greater detail in reference to FIG. 4, the central computer 106 periodically receives signals, via the communications network 104, indicative of the number of rounds played by the player. When the player receives a winning combination for a particular round, the machine 102 dispenses an award to the player from an awards table such as Table I above and the machine 102 also provides a signal, via the network 104, to the central computer 106 which is indicative of the winning combination received by the player. Hence, the central computer 106 keeps track of the total number of rounds played by the player and also keeps track of the winning combinations received by the player. As will be described in greater detail hereinbelow, this information is used to determine whether the player has won the multiple events game by completing the set of winning combinations within a pre-selected number of rounds and to dispense an award accordingly.

FIG. 4 is a flow chart which illustrates one preferred embodiment of the operation of the system 100 as it implements a multiple events awards game. In the preferred embodiment, the processor 133 in the system interface electronics 132 (FIG. 2) receives signals from the central computer 106 indicative of the player's current status in playing the game. In other words, at the start of a play session, the central computer 106 downloads to the game 102 the player's current number of rounds played, the current winning combinations received and the current amount of monies wagered. The processor 133 then updates these values as the player plays the game and determines if the player has received the pre-selected set of winning combinations within the pre-determined number of rounds. The processor 133 also periodically updates the records in the central computer 106 by sending an appropriate signal to the central computer 106 via the network 104. The operation of the system 100 will now be described in greater detail in reference to the flow chart shown in FIG. 4.

From the start state 300, at the start of each round, the player manipulates the player identification input device 130 causing the processor 133 and the central computer 106, to receive, in state 302, a signal from the game 102 which contains encoded information that uniquely identifies the player. The computer 106 then, in state 304, retrieves from the memory 210 (FIG. 3), information about the player from the player ID line 214, information about the multiple events game selected by the player from the winning set line 216, information about the winning combinations previously obtained (if any) from the wining hands line 218, information about the total number of rounds played by the player from the total hands line 220 and information about the total monies wagered from the monies wagered line 221.

The computer 106 then sends a signal, in state 306, via the network 104, to the processor 134, containing the information retrieved in state 304. In the preferred embodiment, this information is used by the processor 133 to perform calculations relating to the winning set games as described below and to update the display 134. As shown FIG. 2, the display 134 provides a graphical indication of the winning combinations in the set of total winning combinations that have been attained by the player and, hence, an indication of the combinations that need to be obtained. As is also illustrated in FIG. 2, the display 134 provides an indication of the available award for completing the set of winning combinations within a specified number of hands.

In the embodiment shown in FIG. 2, the display 134 is a display that is separate from the main display 110 of the video machine 102. However, in the preferred implementation, the video machine 102 is modified so that the display 110 simultaneously displays information about the particular round being played by the player and also displays, in response to signals from the computer 106, information about the multiple events award game that the player is currently playing.

Once the central computer 106 has provided this information to the processor 133, the processor 133 then awaits, in state 310, a signal from the game processor 120 (FIG. 2) indicating that the player has played a new round of the game and indicating the winning combination achieved by the player (if any). In the video poker machine 102 described hereinabove, the player initiates a new round by making a wager and depressing the deal button. Once the processor 133 determines, in decision state 312, that the player has initiated a new round, the processor 133 then updates, in state 314, the information about the total hands played that the processor 133 received from the computer 106 in state 306. The processor 133 also periodically sends a signal to the central computer 106 indicative of the new total hands played information so that the computer 106 can update the total hands played line 220 in the file 212 of the memory 210 for this player. The processor 133 also periodically sends information to the central computer 106 indicative of the total monies wagered so that the central computer 106 can update the total monies wagered line 221. It will be understood that the processor 133 has registers that are updated continuously as the player plays the game. However, the processor 133 only sends signals to the central computer 106 periodically so as to minimize traffic on the network 114.

The processor 133 then determines, in decision state 316, whether the player has received a winning combination in the round. If the player has received a winning combination, the machine 102 sends a signal indicative of the winning combination to the processor 133. The processor 133 then updates, in state 320, the information about the winning hands obtained by the player that the processor 133 received in state 306. The processor 133 also periodically sends a signal to the central computer 106 indicative of the new winning combinations received information so that the computer 106 can update the winning combinations received line 218 in the file 212 of the memory 210 for this player.

The processor 133 then determines, in decision state 322, whether the player has completed the set of winning combinations for the multiple events game. In the embodiment shown in FIG. 2, the processor 133 decides that the player has achieved the winning combination only when the player has received all of the thirteen possible four-of-a-kinds. Once the processor 133 determines that the player has completed the set of winning combinations, the processor 133 then confirms with the central computer 106 that the player has received the set of winning combinations. It will be understood that, in the preferred embodiment, the processor 133 is keeping a current record of the performance of the player, however, upon the player obtaining the correct winning combination, the processor 133 compares its records with those of the central computer 106 to minimize the possibility of cheating at the game location. Upon concluding that the player has received the set of winning combinations, the processor 133 sends an award signal to the machine 102, in state 324, indicating that the player has completed the set and indicating the award to which the player is entitled. As described previously in reference to Table II, the award is calculated from the base award stored in the award line 206 in the game memory 202 corresponding to the set of winning combinations and from the total monies wagered stored in the total monies wagered line 221 in the memory 212 for the player.

In the preferred embodiment, the processor 133 induces the display 134 (FIG. 1) to display the award amount and it also induces the machine 102 to enter a standby mode wherein it will not allow additional rounds to be played until it is reset. This allows the player to be paid by the owner of the machine 102 who then resets the machine 102 for further use. Once the player has been paid, the computer 106 preferably resets the winning hands line 218 and the total hands line 220 in the memory 210 for the player back to the default values. This allows the player to begin playing the game from the starting position.

If, in decision state 316, the processor 133 determines that the player has not received a winning combination, or if, in decision state 322, the computer 106 determines that the player has not completed the set of winning combinations, the computer 106 then proceeds to determine, in decision state 330, if the player has reset the multiple events game. In the preferred embodiment, the player can reset the game, i.e., set the information on the winning hands line 218 and the total hands line 220 back to the default values, e.g., back to zero, by depressing an appropriate button or combination of buttons 112 (FIG. 1) on the machine 102. This induces the processor 133 to send an appropriate signal to the central computer 106 which, in state 332, then resets these values so that the player can start playing the game from the initial starting point. It can be appreciated that the player may want to restart the game after playing enough rounds so that the possible awards are small. For example, in the game corresponding to Table II, if the player has played 10,000 hands and has not yet obtained all thirteen four-of-a-kinds, the only award open to the player would be $5.00. In that case the player may decide to restart the game, e.g., reset the rounds played counter and erase the previously obtained winning combinations to play for the $100,000.00 prize awarded for obtaining all thirteen four-of-a-kinds in 2,000 rounds.

If the processor 133 determines in decision state 330 that the player has not reset the game, or if the player has reset the game and the processor 133 has adjusted the information in the player's file 212 (FIG. 3) accordingly, the processor 133 then determines, in decision state 334, whether the player has ended his or her playing session. In the preferred embodiment, the player ends his or her playing session by depressing an appropriate combination of buttons on the player identification input device to signal an end of the play session. Further, the processor 133 can also be programmed to assume that the player has ended the play session when there is a lack of activity on the game 102 for a predetermined period of time.

If the processor 133 determines in decision state 334 that the player has not ended the session, the processor returns to state 310 wherein it awaits new hand information from the game 102. Alternatively, if the processor 133 determines in decision state 334 that the player has ended the session, the processor 133 then sends a confirmation signal to the central computer 106 wherein the data in the central computer 106 about the players performance, i.e., the information on the winning hands line 218, the total hands line 220 and the total monies wagered line 221 of the player's data structure 210 (FIG. 3), is updated by the information retained by the processor 133. Subsequently, the processor 133 returns to the start state 300 to await another player.

Hence, once the player has initiated a session into the card reader 130, the processor 133 then performs a function whereby a record of the player's performance in a plurality of rounds of the game is updated to reflect the player's performance during the rounds comprising the session. The overall performance of the player over the course of a plurality of rounds is then kept up to date. In the embodiment described above, the system 100 keeps track of the number of rounds played by the player and it also keeps track of whether the player has received a pre-selected set of winning combinations within a pre-selected number of rounds. In the event that the player has received the pre-selected set of winning combinations within the pre-selected number of rounds, the system 100 preferably distributes a winning award that is calculated, based on the probabilities of obtaining the set of winning combinations, so that the overall hold percentage of the system is substantially maintained at a desirable percentage taking into account any awards given by the individual machines for winning combinations achieved by the player.

In this way, a gaming system gives awards on the player's performance during multiple events and can thereby support large awards without significantly affecting the overall hold percentage of the game. The gaming system can be implemented on any of a number of well known gaming machines, including video poker machines as described above, slot machines, twenty-one machines, etc. Further, while the preferred embodiment described an implementation on a video poker machine wherein the multiple events awards were given for completing a set of different card combinations, e.g., all thirteen four-of-a-kinds, any of a number of different card combinations can also be used as the basis for the multiple events award without departing from the spirit of the present invention.

For example, in one implementation it may be desirable to base the multiple events awards on the player obtaining a specific number of a particular winning combinations within the pre-selected number of hands. Specifically, in one implementation, the player may obtain the multiple events awards based on the player receiving a pre-selected number of flushes within a pre-selected number of rounds. In any implementation, however, the multiple events award is preferably calculated on the basis of the probability of obtaining the winning set, e.g., the pre-selected number of flushes, within the pre-selected number of rounds and on the basis of the desired hold percentage for the gaming machine.

Although the foregoing description of the preferred embodiment of the present invention has shown, described and pointed out the fundamental novel features of the invention, it will be understood that various omissions, substitutions, and changes, in the form of the detail of the apparatus as illustrated, as well as the uses thereof, may be made by those skilled in the art, without departing from the spirit of the present invention. Consequently, the scope of the invention should not be limited to the foregoing discussion, but should be defined by the appended claims.

What is claimed is:

1. A multiple events awards system comprising:

a gaming machine which randomly assigns game elements to a player in response to the player initiating a round of the game, wherein said gaming machine determines whether said player has been assigned a pre-selected winning combination of game elements and provides signals indicative thereof; and a controller which receives signals from said gaming machine indicative of said player's performance in a round of said game, wherein said controller maintains a record of said player's performance over a plurality of rounds of said game and determines whether the player has obtained a pre-selected set of winning combinations within a selected number of rounds and wherein said controller also determines that a first award is to be provided to said player when said player has obtained said pre-selected set of winning combinations within said selected number of rounds.

2. The system of claim 1, wherein said gaming machine includes a player identification input device which said player can manipulate to uniquely identify himself and wherein said gaming machine provides a signal to said controller indicative of said player when said player has manipulated said device.

3. The system of claim 1, wherein said controller determines whether the player has obtained a preselected set of winning combinations within a pre-selected number of rounds.

4. The system of claim 3, wherein said gaming machine is a video poker machine and wherein said gaming machine determines whether said player has received one of a number of pre-selected winning combinations that include a pair, two pair, three-of-a-kind, a full house, a straight, a flush, a four-of-a-kind and a royal flush.

5. The system of claim 4, wherein said gaming machine includes a wagering system that receives wagers from said player and an awards dispensing system that dispenses a second award to said player in response to said player receiving one of said number of pre-selected winning combinations.

6. The system of claim 5, wherein the size of said second award is based on the probability of obtaining the corresponding winning combination and on a desired hold percentage of monies wagered using said wagering system that is to be retained by said gaming machine.

7. The system of claim 6, wherein said set of winning combinations comprises obtaining thirteen different four-of-a-kinds.

8. The system of claim 7, wherein said first award is calculated based both on the probability of obtaining said set of winning combinations within a pre-selected number of rounds and on said desired hold percentage of monies wagered using said wagering system that is to be retained by said gaming machine.

9. The system of claim 8, wherein said player wagers at least $1.25 per round and said first award is determined by said controller according to the following table:

TABLE II

| Hit all 13 four-of-a kinds in: | |
|---|---|
| 2,000 hands or less to win | $100,000 |
| 3,000 to 2001 hands to win | $1,000 |
| 4,000 to 3001 hands to win | $100 |
| 6,000 to 4001 hands to win | $20 |
| 7,000 to 6001 hands to win | $10 |
| 49,999 to 7001 hands to win | $5 |
| After 50,000 hands win (consolation prize) | $5 |

10. The system of claim 9, wherein the values of said first award are selected so that the hold percentage of said gaming machine is decreased by no more than 0.14%.

11. The system of claim 10, further comprising a plurality of gaming machines wherein said controller simultaneously receives signals from each of said gaming machines about the performance of a plurality of players in playing said plurality of gaming machines and said controller simultaneously determines that said first award is to be provided to each of said plurality of players who have obtained said pre-selected set of winning combinations.

12. A multiple events system comprised of:

a gaming machine which randomly assigns game elements to a player in response to said player initiating a round of a game implemented on said machine wherein said player receives an award when said player has been assigned a pre-determined winning combination of said game elements;

a processor which receives signals which are indicative both of said player playing a round of said game and of winning combinations of game elements received by said player; and a storage device which receives signals from said processor wherein said storage device is organized so that a first record is maintained of the number of rounds played by said player and a second record is also maintained of the winning combinations received by said player and wherein said processor uses the information in said first and said second record to determine if said player has received a pre-determined set of winning combinations within a selected number of rounds and, if said player has received said set of pre-determined winning combinations within said selected number of rounds said processor provides a signal indicating that said player should receive a first award.

13. The system of claim 12, wherein said gaming machine is comprised of a video poker machine which assigns representations of cards to said player out of a fifty-two playing card deck and said gaming machine determines whether said player has received one of a number of pre-selected winning combinations which include a pair, two pair, three-of-a-kind, a full house, a straight, a flush, a four-of-a-kind and a royal flush.

14. The system of claim 13, wherein said set of winning combinations comprises thirteen different four-of-a-kinds.

15. The system of claim 13, wherein said set of winning combinations comprises a pre-selected number of a four-of-a-kind comprised solely of aces.

16. The system of claim 12, wherein said gaming machine includes a wagering system whereby said player can place wagers and receive awards from said gaming machine when said player has been assigned said winning combinations.

17. The system of claim 16, wherein said processor determines that said first award provided to said player for obtaining said set of winning combinations shall be based, at least in part, on the probability of obtaining said set of winning combinations and also shall be selected so that said gaming machine still substantially retains a pre-selected hold percentage of all monies wagered over time.

18. The system of claim 12, wherein said storage device receives signals from a plurality of processors associated with a plurality of gaming machines and said storage device builds records indicative of the performance of a plurality of players in playing said plurality of gaming machines.

19. The system of claim 18, further comprising a central controller associated with said storage device and wherein said central controller determines whether any of said plurality of players has received said set of pre-determined winning combinations within a pre-determined number of rounds and then provides a signal that said players who have received said set of pre-determined winning combinations within said pre-determined number of rounds are entitled to said first award.

20. The system of claim 19, wherein said plurality of gaming machines are located at disparate locations and are interconnected to said storage device via a communications network.

21. The system of claim 12, wherein a player can reset said first and second records in said storage device to default values while using said gaming machine.

22. A multiple events wagering system comprising:

a plurality of video poker gaming machines wherein each video poker machine assigns card representations to one of a plurality of players and subsequently determines whether said player has been assigned card representations which define one of a plurality of winning combinations;

a plurality of processors associated with each of said plurality of games wherein each of said processors receives signals from said respective gaming machines indicative of both the number of rounds played by a particular player and other winning combinations received by said player;

a communications network receiving signals from each of said plurality of processors;

a central computer which receives signals from said plurality of processors via said communications network indicative of the number of rounds played by each of said plurality of players and also indicative of the winning combinations received by each of said players; and a memory, receiving signals from said central computer, which is logically organized so as to include a file for each of said plurality of players containing information indicative of the number of rounds played by said player and also indicative of the winning combinations received by said player, wherein said multiple events wagering system evaluates for each of said plurality of players whether said player has received a pre-determined set of winning combinations within a pre-selected number of rounds.

23. The system of claim 22, wherein said video poker machine provides a first award when said player receives one of said following awards at the end of a round: a pair (jacks or better), two pair, three-of-a-kind, a straight, a flush, a straight flush, a full house, a four-of-a-kind and a royal flush.

24. The system of claim 23, wherein said set of winning combinations comprises obtaining thirteen different four-of-a-kinds.

25. The system of claim 24, wherein said processor provides an indication that a player who has received said set of winning combinations within said pre-selected number of rounds is entitled to a second award.

26. The system of claim 25, wherein said second award is selected based, at least in part, on the probability of obtaining said set of winning combinations within said pre-selected number of rounds, and is also selected so that said system substantially retains a certain hold percentage of all monies wagered over time taking into account the monies distributed to said plurality of players as first or second awards.

27. A method of playing a multiple events game comprising the steps of:

randomly assigning to a player a plurality of game elements;

determining, at an end of a round, whether said player has received a pre-determined winning combination of game elements;

recording the number of rounds played by said player;

recording the winning combinations received by said player within said recorded number of rounds;

determining whether said player has received a pre-selected set of winning combinations within a pre-selected number of rounds; and providing an award to said player upon determining that said player has received said pre-selected set of winning combinations within said pre-selected number of rounds.

28. The method of claim 27, further comprising the step of providing a first award to said player when said player has received said pre-selected set of winning combinations within said pre-selected number of rounds.

29. The method of claim 28, further comprising the step of receiving a wager from said player at the beginning of said round.

30. The method of claim 29, wherein said first award is selected so that said gaming machine retains a pre-determined hold percentage of all monies wagered taking into account the monies dispensed as a result of said player receiving said first award.

31. The method of claim 30, wherein said step of assigning said player a plurality of game elements comprising randomly assigning to the player a plurality of playing cards selected from a fifty-two card deck and wherein the step of determining whether the player has received a winning combination comprises determining whether the player has received one of the following winning poker combinations: a pair (jacks or better), two pair, three-of-a-kind, a straight, a flush, a full house, a straight flush, a four-of-a-kind or a royal flush.

32. The method of claim 31, wherein the step of determining whether the player has received said pre-selected set of winning combinations within a pre-selected number of rounds comprises determining whether the player has received thirteen different four-of-a-kinds within the pre-selected number of rounds.

33. The method of claim 32, wherein the step of providing said first award comprises providing an award based at least in part on the following table:

TABLE II

| Hit all 13 four-of-a kinds in: | |
|---|---|
| 2,000 hands or less to win | $100,000 |
| 3,000 to 2001 hands to win | $1,000 |
| 4,000 to 3001 hands to win | $100 |
| 6,000 to 4001 hands to win | $20 |
| 7,000 to 6001 hands to win | $10 |
| 49,999 to 7001 hands to win | $5 |
| After 50,000 hands win (consolation prize) | $5 |

* * * * *